US010760845B2

(12) United States Patent
Henriksson

(10) Patent No.: US 10,760,845 B2
(45) Date of Patent: Sep. 1, 2020

(54) SNOW MAKING FACILITY AND METHOD FOR DISCHARGING ARTIFICIAL SNOW FROM A SNOW MAKING FACILITY

(71) Applicant: F3 Snow Technologies AB, Rimbo (SE)

(72) Inventor: Jonas Henriksson, Rimbo (SE)

(73) Assignee: F3SNOW AB, Rimbo (SE)

( * ) Notice: Subject to any disclaimer, the term of this patent is extended or adjusted under 35 U.S.C. 154(b) by 0 days.

(21) Appl. No.: 15/780,307

(22) PCT Filed: Nov. 24, 2016

(86) PCT No.: PCT/SE2016/051163
§ 371 (c)(1),
(2) Date: May 31, 2018

(87) PCT Pub. No.: WO2017/095306
PCT Pub. Date: Jun. 8, 2017

(65) Prior Publication Data

US 2018/0347881 A1 Dec. 6, 2018

(30) Foreign Application Priority Data

Dec. 2, 2015 (SE) ..... 1551580

(51) Int. Cl.
*F25C 3/04* (2006.01)
*F25C 1/16* (2006.01)
(Continued)

(52) U.S. Cl.
CPC ..... *F25C 3/04* (2013.01); *F25C 1/16* (2013.01); *F25C 3/00* (2013.01); *F25C 5/20* (2018.01); *F25C 2400/10* (2013.01)

(58) Field of Classification Search
CPC ..... F25C 3/04; F25C 3/00; F25C 5/20; F25C 1/16; F25C 2400/10
(Continued)

(56) References Cited

U.S. PATENT DOCUMENTS 1,976,204 A 10/1934 Voorhees et al.
2,136,758 A * 11/1938 Rosberg ..... A63J 5/028 239/2.2
(Continued)

FOREIGN PATENT DOCUMENTS

CN 2408412 Y 11/2000
CN 2648361 Y 10/2004
(Continued)

OTHER PUBLICATIONS

PCT International Preliminary Report on Patentability in PCT/SE2016/051163 dated Jun. 5, 2018, 6 pages.
(Continued)

*Primary Examiner* — Steven J Ganey
(74) *Attorney, Agent, or Firm* — Servilla Whitney LLC

(57) ABSTRACT

A method of discharging artificial snow (S) from a snow making facility (20) including an evaporator vessel (1) and producing snow by means of the technique of freezing water under vacuum pressure by maintaining a vacuum pressure in the evaporator vessel and producing water vapor that absorbs the latent heat of vaporization from the water, whereby the water temperature drops until it freezes and reaches the super cooling temperature that corresponds to the existing vacuum pressure, wherein produced snow is withdrawn from a bottom portion (1A) of the evaporator vessel by means of a first pipe screw conveyor (4), the withdrawn snow is conveyed from the first screw conveyor through a controlled first valve (6) and into a second pipe screw conveyor (5) and snow is discharged to the atmo-
(Continued)

sphere from the second screw conveyor through a controlled second valve (7). A facility for producing artificial snow as well as a method for controlling the quality of produced artificial snow are also provided.

7 Claims, 2 Drawing Sheets

(51) Int. Cl.
*F25C 5/20* (2018.01)
*F25C 3/00* (2006.01)

(58) Field of Classification Search
USPC ..... 239/2.2, 14.2; 62/100, 74, 347, 268
See application file for complete search history.

(56) References Cited

U.S. PATENT DOCUMENTS

| | | | | |
|---|---|---|---|---|
| 3,257,815 | A * | 6/1966 | Brocoff | F25C 3/04 239/2.2 |
| 6,038,869 | A | 3/2000 | Lee et al. | |
| 6,938,830 | B2 * | 9/2005 | Bucceri | F25C 3/04 239/14.2 |

FOREIGN PATENT DOCUMENTS

| | | | |
|---|---|---|---|
| CN | 1610810 | A | 4/2005 |
| CN | 201014657 | Y | 1/2008 |
| CN | 102706061 | A | 10/2012 |
| CN | 103562661 | A | 2/2014 |
| DE | 917491 | C | 9/1954 |
| DE | 2618911 | A1 | 12/1977 |
| JP | H0571838 | A | 3/1993 |
| JP | H0972643 | A | 3/1997 |
| JP | 2001012834 | A | 1/2001 |
| JP | 2004238155 | A | 8/2004 |
| JP | 2014119238 | A | 6/2014 |
| WO | 97/29330 | A1 | 8/1997 |
| WO | 2015/092730 | A1 | 6/2015 |

OTHER PUBLICATIONS

PCT International Search Report in PCT/SE2016/051163 dated Feb. 21, 2017, 4 pages.
PCT International Written Opinion in PCT/SE2016/051163 dated Feb. 21, 2017, 5 pages.
Machine Translation of DE 917491, 7 pages.
Extended European Search Report in EP16871149, dated Jun. 5, 2019, 5 pages.

* cited by examiner

SNOW MAKING FACILITY AND METHOD FOR DISCHARGING ARTIFICIAL SNOW FROM A SNOW MAKING FACILITY

CROSS REFERENCE TO RELATED APPLICATIONS

This is a National Phase entry of International Application No. PCT/SE2016/051163, filed Nov. 24, 2016, which claims priority to Swedish Patent Application No. 1551580-2, filed Dec. 2, 2015, the disclosures of which are incorporated herein by reference in their entireties.

TECHNICAL FIELD

The present technology generally concerns a process of producing snow and more specifically relates to a method as well as equipment for discharging and distributing snow from a snowmaking system.

BACKGROUND

The snowmaking technology relies on the laws of physics regarding the fact that the boiling point of water changes with the surrounding pressure. Basically, for the snowmaking process a vacuum pressure corresponding to the boiling point of water at a temperature below 0° C. produces water vapor that absorbs the latent heat of vaporization from the water. The water temperature drops until it freezes and reaches the super cooling temperature that corresponds to the existing vacuum pressure.

The technique of freezing water under vacuum pressure has been well established in different industrial areas, such as for cooling and freeze drying applications. There are, however, presently only two existing commercial facilities/systems that produce snow using this technique. The existing systems produce an ice slurry that is pumped in a loop. From said ice slurry loop water is removed to produce snow. A major problem with the above discussed systems is that they require an anti-freezing protection in the ice slurry loop. The used anti-freeze protection is normally in the form of glycol or a NaCl solution, which in both cases are partially discharged with the snow and thereby pollute the environment. The second problem is that you can only produce wet snow with practically no possibilities to control the quality of the produced snow.

Basic systems for producing ice particles or snow using a vacuum technique as described above are disclosed e.g. in U.S. Pat. No. 6,038,869, WO8203679 and WO-2006090387. These systems produce an ice slurry from which the water is or can be removed later in the process depending upon the intended use for the produced ice slurry. When water is removed the snow is still wet, resembling "spring snow" having a high density. Using such methods for making snow, it is thus not possible to control the snow quality and there is also an above mentioned need for an environmentally unfriendly anti-freezing protection in the ice slurry loop.

RELATED ART

Documents DE917491, SE85551 and U.S. Pat. No. 1,976,204 disclose systems for producing ice. Said systems all use a screw to form an ice plug that serves to maintain the vacuum within the evaporator vessel. If said systems were instead used for producing snow the mechanical properties of the resulting snow would be destroyed and it would not be possible to control the snow quality, such as the density of the produced snow.

SUMMARY

It is a general object to provide an improved solution to the above discussed problems.

In particular it is an object to suggest an improved method for producing snow of a desired quality, such as regarding mechanical properties or density.

In particular it is another object of the invention to suggest equipment for producing snow of a desired quality, such as regarding mechanical properties or density.

These and other objects are met by the technology as defined by the accompanying claims.

The technology generally relates to a method of providing high quality snow from snow produced with the known technique of freezing water under vacuum pressure.

In a basic aspect of the technology there is provided an improved method of discharging artificial snow from a snow making facility having an evaporator vessel. Snow is produced by means of the technique of freezing water under vacuum pressure by maintaining a vacuum pressure in the evaporator vessel and producing water vapor that absorbs the latent heat of vaporization from the water. Thereby the water temperature is caused to drop until it freezes and reaches the super cooling temperature that corresponds to the existing vacuum pressure. In a basic configuration the method includes withdrawing the produced snow from a bottom portion of the evaporator vessel by means of a first pipe screw conveyor, conveying the withdrawn snow from the first screw conveyor through a controlled first valve and into a second pipe screw conveyor and discharging the snow to the atmosphere from the second screw conveyor through a like-wise controlled second valve.

In accordance with a further aspect of the technology there is provided a snow making facility for discharging artificial snow and including an evaporator vessel, a vacuum generating device being connected to the evaporator vessel for producing and maintaining a vacuum pressure therein and to a condenser. A water supply is provided for distributing water in the evaporator vessel through a water supply line and at least one water nozzle and means are also provided for discharging snow produced in the evaporator vessel therefrom. In a basic configuration the facility includes a first pipe screw conveyor communicating with a lower portion of the evaporator vessel to receive snow therefrom, a second pipe screw conveyor communicating with an outlet end of the first pipe screw conveyor through a controlled first valve to selectively receive snow therefrom when the first pipe screw conveyor is operated, and a controlled second valve communicating an outlet end of the second pipe screw conveyor with the surrounding atmosphere to selectively discharge produced snow from the second pipe conveyor when it is operated.

According to a further aspect of the technology an improved method is suggested for controlling the quality of artificially produced snow discharged from a snow making facility producing snow by means of the technique of freezing water under vacuum pressure. Said vacuum pressure is maintained in a vacuum vessel and water vapor is produced that absorbs the latent heat of vaporization from the water so that the water temperature drops until it freezes and reaches the super cooling temperature that corresponds to the existing vacuum pressure. In a basic configuration the water flow into the evaporator vessel is controlled as a function of the vacuum pressure in the evaporator vessel or alternatively the vacuum pressure in the evaporator vessel is controlled as a function of the water flow into the evaporator vessel, so as to produce water droplets that are partially frozen, resulting in a higher density, or completely frozen, resulting in a lower density.

Preferred further developments of the basic idea of the present technology as well as embodiments thereof are specified in the dependent subclaims.

Advantages offered by the present technology, in addition to those described above, will be readily appreciated upon reading the below detailed description of embodiments of the technology.

BRIEF DESCRIPTION OF THE DRAWINGS

The invention and its further objects and advantages will be best understood by reference to the following description taken together with the accompanying drawings, in which.

DETAILED DESCRIPTION

The technology will now be explained with reference to exemplifying embodiments of a snow making facility and a method of discharging artificial snow from a snow making facility which are illustrated in the accompanying drawing figures. The embodiments serve to exemplify the use of the principles of the technology in an application for making artificial snow specifically for skiing applications. It shall be emphasized though, that the illustrations serve the purpose of describing embodiments of the technology and are not intended to limit the technology to details or to any specific field of application thereof.

As was indicated in the introduction the general technique of freezing water under vacuum pressure has been known for several decades and has mainly been used for producing ice or for general cooling purposes. Lately, in a development of the same general technique, equipment has been developed for producing artificial snow especially for skiing applications, such as cross-country skiing and alpine skiing. The main problem of this prior art snow making equipment is that it only produces snow of a wet, high density quality that may be referred to as spring-type snow, having a density in the range of 600-700 kg/m$^3$.

To overcome such disadvantages and problems that are encountered within this technical field and that were also briefly mentioned in the introduction the present technology now suggests a novel approach for optimizing the quality of produced artificial snow. The unique features of the suggested methods and facility provide essential advantages over existing techniques. The methods enable producing artificial snow of a much higher quality than before, especially with regard to the density of the produced snow. This in turn provides further advantages such as an improved possibility of continuously controlling the quality of the produced snow.

Figure 1:
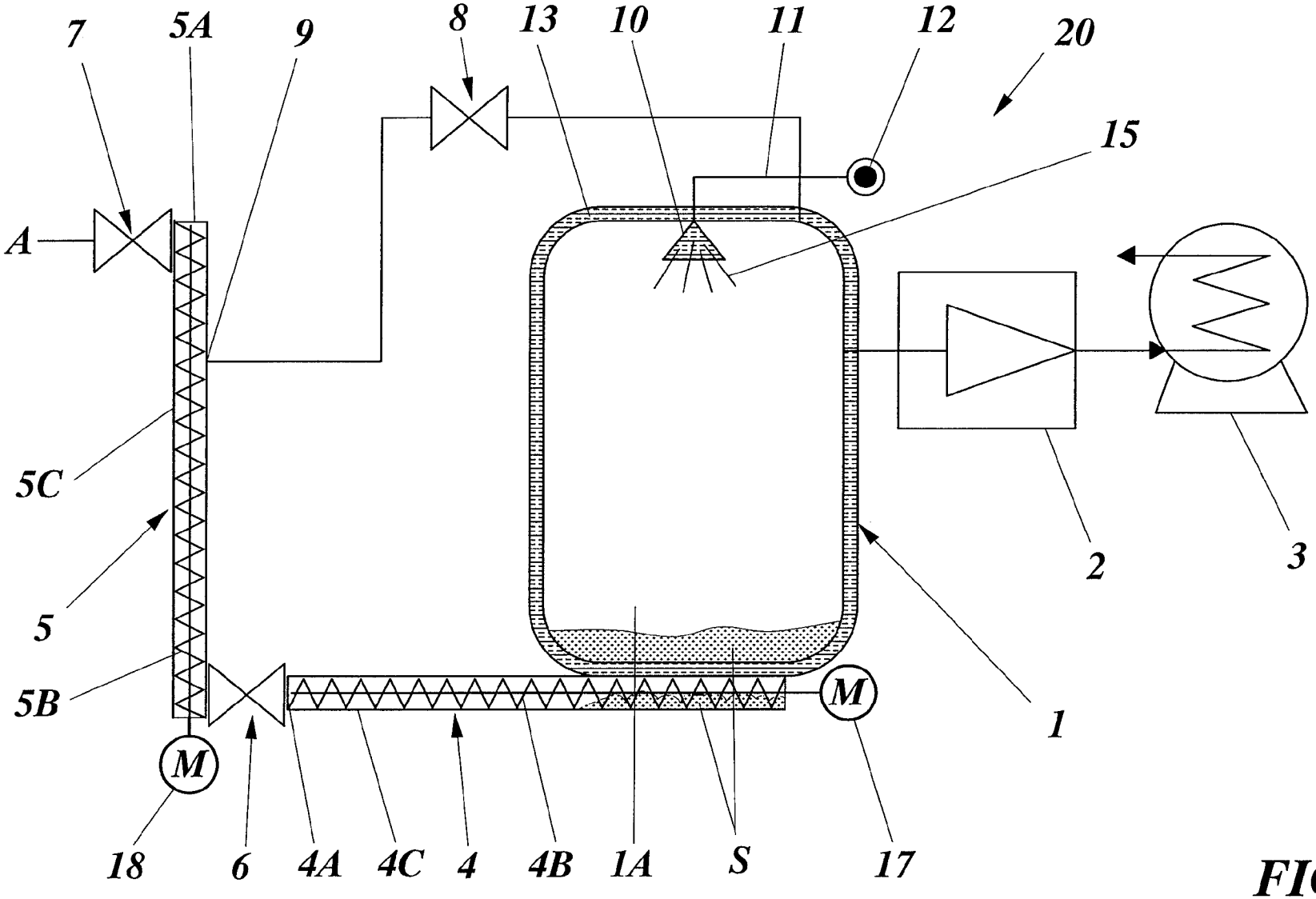
FIG. 1 is a schematical illustration of an embodiment of a snow making facility according to the presently proposed technology.
Figure 2:
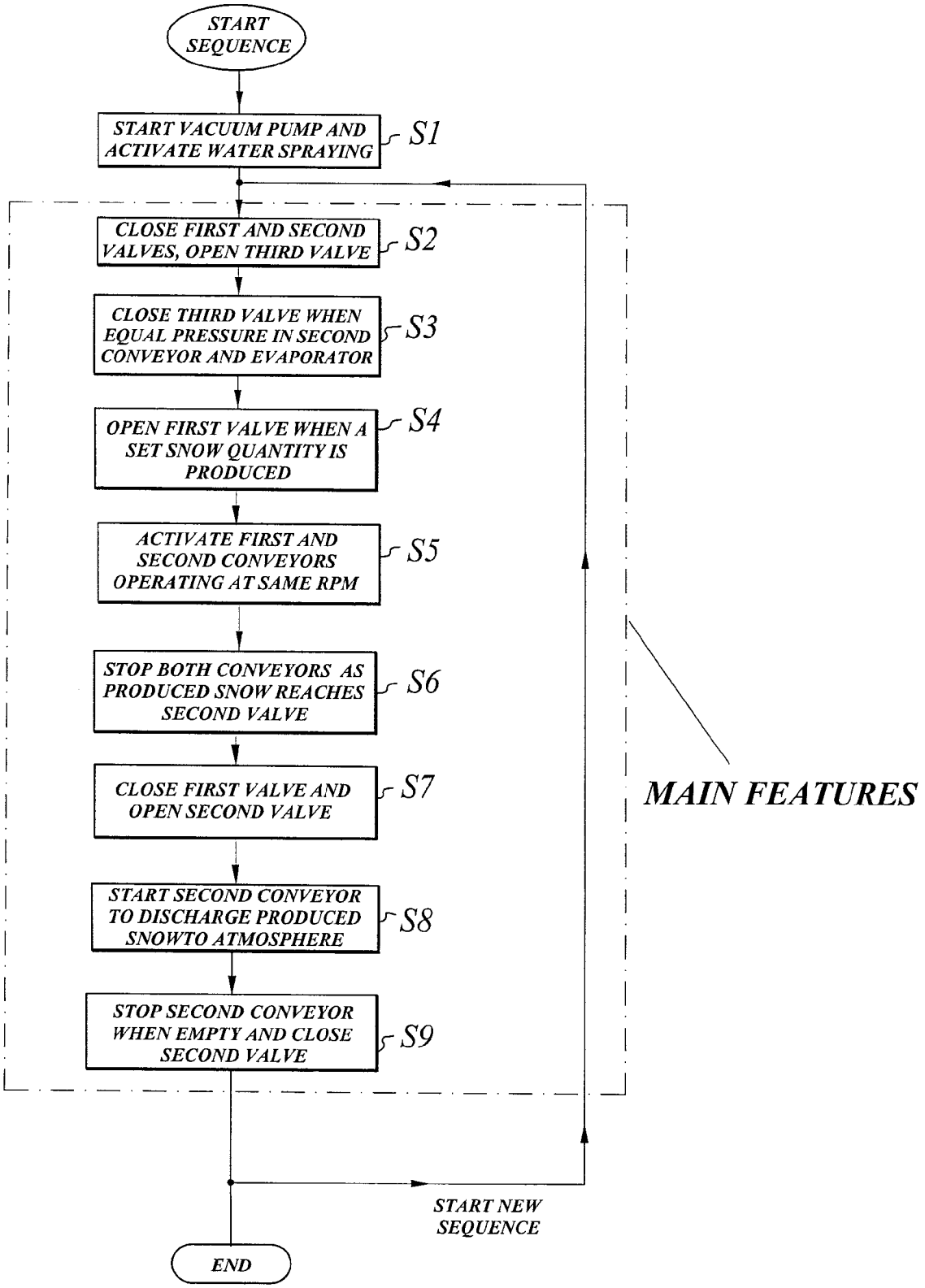
FIG. 2 is a schematic flow diagram of a method of discharging artificial snow from a snow making facility of FIG. 1.

The present technology will now be explained with reference to an exemplifying embodiment of the technology that is illustrated in the accompanying drawing FIGS. 1-2. FIG. 1 very schematically illustrates an exemplary embodiment of a basic snow making facility 20 as used for the present technology. The facility 20 is based on the mentioned prior technique of freezing water under vacuum pressure—in particular a vacuum pressure corresponding to a boiling point of water at a temperature below 0° C.—for producing or making artificial snow S. The facility includes an evaporator vessel 1, a vacuum generating device 2, such as a vacuum pump, being connected at one end to the evaporator vessel for producing and maintaining a vacuum pressure therein and at the other, opposite end to a condenser 3. A water supply 12 is provided for supplying water to and distributing water in the evaporator vessel 1 through a water supply line 11 and at least one water nozzle 10. Means must also be provided for discharging snow produced in the evaporator vessel 1 therefrom. So far the described facility is based on known technique.

However, in clear contrast to such known technique the presently proposed facility includes a unique configuration of means 4-7 for discharging the snow S produced in the evaporator vessel 1 therefrom and into the surrounding atmosphere without impairing the quality of the produced snow S. Said snow discharging means include a first pipe screw conveyor 4 that communicates with a lower portion 1A of the evaporator vessel 1 to receive produced snow S therefrom. It will be understood that the first pipe screw conveyor 4 communicates with the evaporator vessel 1 through an appropriately dimensioned opening (not illustrated in detail) in the bottom of said vessel 1. The pipe screw conveyor is selectively activated by a motor 17 being drivingly connected to a screw blade 4B that is rotatably journalled in a cylindrical pipe-type conveyor casing 4C.

At an outlet end 4A of the first pipe screw conveyor 4 communicates with a second pipe screw conveyor 5 through a controlled first valve 6. The first valve 6 is of any appropriate type, such as a slide or a gate valve, for controlling the feed of produced snow S between the two pipe screw conveyors 4, 5. The first valve 6, as well as the later described second and third valves 7 and 8, respectively, may be controlled in any appropriate way, preferably remotely by means of an electric type valve control that may be coupled with a PLC-based control system. It will be understood that the second pipe screw conveyor 5 selectively receives produced snow S from the first pipe screw conveyor 4 when this is operated and the first valve 6 is opened.

The second pipe screw conveyor 5 is likewise selectively activated by a motor 18 that is drivingly connected to a screw blade 5B being rotatably journalled in a cylindrical pipe-type conveyor casing 5C. At an outlet end 5D the second pipe screw conveyor 5 communicates with a controlled second valve 7 that is preferably of the same type as the first valve 6. Through the second valve 7 the second pipe screw conveyor 5 communicates with the surrounding atmosphere to selectively discharge produced snow S from the second pipe conveyor 5 when it is operated.

The snow making facility 20 may preferably also be provided with a branch-off 9 from the second pipe screw conveyor 5. Via said branch-off 9 the second pipe screw conveyor 5 is connected to the evaporator vessel 1 through a third controlled valve 8 to thereby selectively communicate vacuum pressure similar to that in the evaporator vessel 1 at least to the second pipe screw conveyor 5. This will permit that the quality, mainly the density, of the produced snow S is maintained as good as possible up to its discharge from the facility 20.

The evaporator vessel 1 is configured to hold a deep vacuum and the vessel 1 may be manufactured from any one of a number of different materials, as is well known from vacuum pressure applications within various fields, as long as the vessel manages the required vacuum pressure levels. To provide optimal effect for the facility 20 the height of the evaporator vessel 1 shall preferably be determined as a function of the vacuum pressure produced therein and of the size and temperature of water droplets 15 entering the evaporator vessel by being sprayed from the at least one water nozzle 10. This is to ensure that the droplets 15 freeze before reaching the bottom portion 1A of the vessel 1. Furthermore, the evaporator vessel 1 should preferably be provided with an insulation layer 13 for minimizing the warming effect of ambient temperature that might otherwise warm the inside of the vessel 1 were the snow is produced and stored a short time before being distributed out from the evaporator vessel 1.

In the following will be described a proposed method or process of discharging artificial snow S from a snow making facility 20, as indicated schematically in FIG. 1, and thus including the evaporator vessel 1 wherein snow is produced by means of the technique of freezing water under vacuum pressure. A vacuum pressure is maintained in the evaporator vessel 1 and water vapor is produced that absorbs the latent heat of vaporization from the water, whereby the water temperature drops until it freezes and reaches the super cooling temperature that corresponds to the existing vacuum pressure. The method/process will be generally described step by step, with reference to the schematic flow diagram of FIG. 2. In sequence step S1 the vacuum pump or equivalent device 2 is started and water spraying through the nozzle or nozzles 10 is activated when a proper vacuum pressure level has been obtained in the evaporator vessel 1. In step S2, prior to reaching a certain level of snow in the evaporator vessel 1 and before the distribution of snow out from the evaporator vessel 1 can start the first and second valves 6, 7 are closed. On the other hand, the third valve 8 is opened to selectively create a similar or essentially the same vacuum pressure level in at least the second pipe screw conveyor 5 as in the evaporator vessel 1. When reaching said equal vacuum pressure level in the evaporator vessel 1 and in the second pipe screw conveyor 5 the third valve 8 may be closed again in step S3.

When an appropriate and predetermined quantity of snow S has been produced in the evaporator vessel 1, gathering in the bottom portion 1A of the vessel 1 as well as in the first pipe screw conveyor 4 below a bottom opening, not illustrated, of the vessel, the first valve 6 is opened in step S4. Then, in the following sequence step S5 the first and second pipe screw conveyors are activated to operate at essentially the same rpm. This activation serves to initially withdraw produced snow S from said bottom portion 1A of the evaporator vessel 1 by means of the first pipe screw conveyor 4. The withdrawn snow is then conveyed from the first pipe screw conveyor 4 through the controlled first valve 6 and into the second pipe screw conveyor 5 which in turn conveys the produced snow S towards an outlet end 5A thereof.

Then, in sequence step S6, both pipe screw conveyors 4 and 5 are stopped when the produced snow S reaches said outlet end 5A and the second valve 7. In step S7 the first valve 6 is then closed and the second valve 7 is opened and finally, in step S8 the second pipe screw conveyor 5 is started again to perform discharging of the snow to the atmosphere, from the second pipe screw conveyor 6 and through said second valve 7. A sequence is then completed in step S9 by deactivating/stopping the now empty second pipe screw conveyor 6 and by closing the second valve 7. Then the process is ready to start a new sequence from step S2. To maintain vacuum pressure and snow production continuously the two pipe conveyor screws 4 and 5 and the two valves 6 and 7 are operated according to a determined program as represented by the different relevant sequence steps.

In a further aspect the technology also concerns a method of controlling the quality of artificially produced snow. The snow quality (density) is a function of water flow, in the form of droplets having a certain size when entering the evaporator vessel 1, the height of the evaporator vessel 1 and the vacuum pressure. By controlling the water flow and the vacuum pressure the water droplets will be partially frozen, resulting in a higher density, or completely frozen, resulting in a lower density. When the vacuum generating device 2 runs at a certain fixed speed it can produce a certain mass of snow/ice in ton/h or a certain volume $m^3$/h, at a given density. When increasing the water flow into the evaporator vessel 1 through the water nozzles 10, with the vacuum generating device 2 working at a fixed speed, for producing snow of a given density, the vacuum generating device 2 is unable to compress and evacuate all the water vapor in the evaporator vessel 1. The vacuum pressure will then rise (towards atmospheric pressure) as a ratio of water flow into the evaporator vessel 1 increases and the water droplets entering the vessel will only freeze partially. Increasing the water flow thus leads to less freezing within the water droplets until they don't freeze at all. Through the proposed method it will therefore be possible to control the process from water droplets not freezing at all and to water droplets freezing completely before reaching the evaporator vessel 1 bottom. The controlling of the density may also be reversed in the meaning that you raise the vacuum pressure towards atmospheric pressure having a fixed water flow. Expressed otherwise, this is done by controlling the water flow into the evaporator vessel 1 as a function of the vacuum pressure in the evaporator vessel or alternatively by controlling the vacuum pressure in the evaporator vessel as a function of the water flow into the evaporator vessel, so as to produce water droplets that are partially frozen, resulting in a higher density, or completely frozen, resulting in a lower density. This latter alternative will provide the same result, except that the performance as regards the produced volume in $m^3$/h will decrease.

The proposed new technology has been described above with specific reference to presently proposed practical embodiments. However, it should be noted that the technology is in no way restricted to said embodiments but may be equally well suited for alternative embodiments intended for specific applications involving special conditions. In the same way it is also possible to use other types of conveyors, valves and vacuum generators than those specifically mentioned here. It shall also be emphasized that although the technology has been described and illustrated with reference to an application for the production of snow for skiing applications it is in no way restricted to such a specific application. The basic principles of the invention may be applied to other types of snow making applications as well as snow making facilities.

The present technology has been described in connection with embodiments that are to be regarded as illustrative examples thereof. It will be understood by those skilled in the art that the present technology is not limited to the disclosed embodiments but is intended to cover various modifications and equivalent arrangements. The present technology likewise covers any feasible combination of features described and illustrated herein. The scope of the present technology is defined by the appended claims.

The invention claimed is:

1. A method of discharging artificial snow from a snow making facility including an evaporator vessel and producing snow by a technique of freezing water under vacuum pressure by maintaining a vacuum pressure corresponding to the boiling point of water at a temperature below 0° C. in the evaporator vessel and producing water vapor that absorbs the latent heat of vaporization from the water whereby the water temperature drops until it freezes and reaches the super cooling temperature that corresponds to the existing vacuum pressure, the method comprising:

withdrawing the produced snow from a bottom portion of the evaporator vessel by a first pipe screw conveyor;

conveying the withdrawn snow from the first screw conveyor through a controlled first valve and into a second pipe screw conveyor; and discharging the snow to the atmosphere from the second screw conveyor through a likewise controlled second valve; whereby a vacuum pressure similar to that in the evaporator vessel is selectively created in at least the second pipe screw conveyor through a third controlled valve connecting the second pipe screw conveyor to the evaporator vessel via a branch-off from the second pipe screw conveyor.

2. The method according to claim 1, which comprises:

closing the first and second valves and opening the third valve prior to reaching a certain level of produced snow in the evaporator vessel;

closing the third valve when equal pressure is present in the evaporator vessel and in the second pipe screw conveyor;

opening the first valve when a set quantity of snow has been produced in the evaporator vessel;

activating the first and second pipe screw conveyors;

stopping both pipe screw conveyors when produced snow reaches the second valve;

closing the first valve and opening the second valve; and starting the second pipe screw conveyor to discharge the produced snow to the atmosphere through the second valve.

3. The method according to claim 2, further comprising stopping the second pipe screw conveyor when it has been emptied and then closing the second valve.

4. The method according to claim 2, wherein the first and second pipe conveyors are activated operating at the same rpm.

5. A snow making facility for discharging artificial snow and including an evaporator vessel, a vacuum generating device being connected to the evaporator vessel for producing and maintaining a vacuum pressure therein and to a condenser, a water supply for distributing water in the evaporator vessel through a water supply line and at least one water nozzle and means for discharging snow produced in the evaporator vessel therefrom, the snow making facility comprising:

a first pipe screw conveyor communicating with a lower portion of the evaporator vessel to receive produced snow therefrom;

a second pipe screw conveyor communicating with an outlet end of the first pipe screw conveyor through a controlled first valve to selectively receive produced snow therefrom when the first pipe screw conveyor is operated;

a controlled second valve communicating an outlet end of the second pipe screw conveyor with the surrounding atmosphere to selectively discharge produced snow from the second pipe conveyor when it is operated; and a branch-off connecting the second pipe screw conveyor to the evaporator vessel through a third controlled valve to thereby selectively communicate vacuum pressure similar to that in the evaporator vessel at least to the second pipe screw conveyor.

6. The snow making facility according to claim 5, wherein a height of the evaporator vessel is a function of the vacuum pressure produced therein and a size and temperature of water droplets entering the evaporator vessel from the at least one water nozzle.

7. The snow making facility according to claim 5, wherein the evaporator vessel has an insulation layer for minimizing a warming effect of ambient temperature.

* * * * *